US005406791A

United States Patent [19]

Bauer

[11] Patent Number: 5,406,791

[45] Date of Patent: Apr. 18, 1995

[54] SUPPORT APPARATUS FOR THE EXHAUST PIPE OF AN INTERNAL COMBUSTION ENGINE

[75] Inventor: Rolf Bauer, Friedrichshafen, Germany

[73] Assignee: MTU Motoren-Und Turbinen-Union Friedrichshafen GmbH, Friedrichshafen, Germany

[21] Appl. No.: 114,771

[22] Filed: Sep. 1, 1993

[30] Foreign Application Priority Data

Sep. 3, 1992 [DE] Germany ..... 42 29 467.3

[51] Int. Cl.[6] ..... F01N 7/10

[52] U.S. Cl. ..... 60/322; 60/323

[58] Field of Search ..... 60/322, 323, 282, 320, 60/321

[56] References Cited

U.S. PATENT DOCUMENTS

| | | | |
|---|---|---|---|
| 2,110,395 | 3/1938 | Fluor | 60/322 |
| 4,018,049 | 4/1977 | Konishi | 60/323 |
| 4,075,836 | 2/1978 | Yamazaki | 60/322 |
| 4,083,182 | 4/1978 | Ikeya | 60/322 |
| 5,022,227 | 6/1991 | Sudmanns | 60/322 |
| 5,056,310 | 10/1991 | Donauer | 60/322 |

FOREIGN PATENT DOCUMENTS

| | | |
|---|---|---|
| 493562 | 5/1950 | Belgium . |
| 1333507 | 12/1963 | France . |
| 2405362 | 5/1979 | France . |
| 335966 | 4/1921 | Germany . |
| 2153440 | 5/1973 | Germany . |
| 3239555 | 4/1984 | Germany . |
| 91 02 926.0 | 9/1991 | Germany . |
| 92 05 294 | 7/1992 | Germany . |
| 1048249 | 11/1966 | United Kingdom . |

*Primary Examiner*—Ira S. Lazarus
*Assistant Examiner*—Daniel J. O'Connor
*Attorney, Agent, or Firm*—Ladas & Parry

[57] ABSTRACT

Support apparatus for the exhaust pipe of an internal combustion engine in which three suspension rods pivotably support the pipe at one longitudinal station and two others engage the pipe at a second longitudinal station. An external radial force is applied to the pipe preferably at a suspension rod at the second station. Specific and constant bearing forces determined by the size of the external force occur essentially independently of the temperature of the exhaust pipe and these forces hold the exhaust pipe in a secure state, free of play, without introducing damaging stresses. In addition, the position of the exhaust pipe at a specific temperature can be obtained by suitable selection of the arrangement and length of the suspension rods.

10 Claims, 1 Drawing Sheet

SUPPORT APPARATUS FOR THE EXHAUST PIPE OF AN INTERNAL COMBUSTION ENGINE

FIELD OF THE INVENTION

The invention relates to support apparatus for the exhaust pipe of an internal combustion engine and more particularly to support apparatus adapted to support the exhaust pipe to accommodate longitudinal expansion and contraction produced by temperature fluctuations of the exhaust pipe.

BACKGROUND AND PRIOR ART

Support apparatus for the exhaust pipe of an internal combustion engine is disclosed in DE 30 17 742 A1. The exhaust pipe disclosed therein serves for collecting and transferring the exhaust gases from an internal combustion engine into an exhaust gas turbocharger. In order to avoid energy losses due to cooling of the exhaust gases, the exhaust pipe is arranged in a housing. The high temperature of the exhaust pipe leads to great heat expansion of the exhaust pipe. Therefore, in order to avoid heat stresses in the exhaust pipe, the exhaust pipe is joined rigidly with the housing only at a central location of the exhaust pipe by means of screws, so that an unrestricted lengthwise expansion of the exhaust pipe is possible in both longitudinal directions. Other attachment points, which are distributed over the length of the exhaust pipe on both sides of the rigid connection are provided to permit free axial displacement. A restriction of axial expansion of the exhaust pipe would produce forces, which would lead to permanent deformation and thus to damage of the exhaust pipe. However, even expansion in the radial direction should not be suppressed, if heat stresses are to be avoided entirely. Freedom from stress is not obtained with the disclosed support apparatus. In addition, a secure support of the exhaust pipe, which is free of play, will not be attained. In order to make unrestricted longitudinal displacements of the exhaust pipe possible, play is necessary at all points of attachment. However, if there is no secure seating of the bearings of the support means dynamic stresses will not be resisted.

In DE-OS 27 00 565, a section of an exhaust pipe for an internal combustion engine is disclosed which consists of a straight piece and an angled piece joined together. The angled piece is attached by means of flanges to the internal combustion engine and the remote end of the straight piece is connected by tube sections to the exhaust pipe by means of an axial compensator. Since the straight pieces are relatively long, they are supported by suspension rods in order to avoid vibrations. Thus no distortions occur due to the suspension rods; these are arranged in two planes, and equilibrations in the direction of the longitudinal axes of both pieces are possible. The suspension rods are attached by ball-and-socket joints to the exhaust pipe and to the support structure. A support of the exhaust pipe which is free of constraining force, however, is not obtained due to the attachment by means of flanges.

A suspension support is also disclosed for an exhaust pipe of a gas motor according to DE-PS 335,966. This suspension support is connected to the exhaust pipe and is supported in an articulated manner on the support structure. The suspension support permits equilibration movements of the exhaust pipe transversely of its expansion direction. Displacements of the exhaust pipe transversely of its longitudinal axis are caused by tubes that are joined to it at an angle, which convey the exhaust gas from the gas engine into the exhaust pipe, and which are subjected to longitudinal changes due to temperature variations. Inadmissible heat stresses in the exhaust pipe system are avoided by the equilibration motions of the suspension support. Since the exhaust pipe is provided with a lining and thus has a considerable weight, the weight of the exhaust pipe is resisted by means of deflecting rollers and a counterweight. Thus an unrestrained resetting of the exhaust pipe is possible corresponding to the expansion of the transfer tubes, since the transfer tubes are not loaded by the weight of the pipe with the lining.

SUMMARY OF THE INVENTION

An object of the invention is to provide support apparatus for an exhaust pipe in which the exhaust pipe is supported free of play and wherein under temperature induced expansions and contractions of the exhaust pipe no substantial effect is produced on the support apparatus.

More particularly, under temperature changes, there is substantially no change produced in the resisting forces provided by the supporting apparatus of the exhaust pipe.

These and other objects of the invention are satisfied by providing support apparatus for the exhaust pipe of an internal combustion engine which is subjected to expansion in the axial and radial directions due to fluctuating temperature comprising supports in a housing surrounding the exhaust pipe to support the exhaust pipe in the vertical, transverse and axial directions, wherein one of the supports supporting the exhaust pipe can freely accommodate displacement of the exhaust pipe, and can be elastically braced against the exhaust pipe, the other supports being formed as suspension rods, which extend between the exhaust pipe and the housing and pivotably engage therewith. Two suspension rods at a first longitudinal station and two other suspension rods at a second longitudinal station spaced axially along the exhaust pipe develop forces to hold the exhaust pipe in a stable position under the action of the force introduced by the elastically braced support.

Thereby, a defined, essentially constant force is introduced into the exhaust pipe by the bracing support, by means of which the suspension rods are loaded, so that they are held in a stable position. Preferably, the suspension rods are arranged on the underside of the exhaust pipe and are aligned such that they act against a downwardly applied external force. Preferably, the suspension rods are arranged symmetrically relative to the planes defined by the vertical and transverse axes and the vertical and longitudinal axes. The suspension rods are inclined toward each other, so that a stable support is developed in the transverse and axial direction. A seating of the exhaust pipe free of play is obtained, whereby also, the magnitude of the support reactions and the forces introduced into the exhaust pipe are limited, so that damaging stresses are avoided. It is a particular advantage that an intentional displacement of the exhaust pipe can be achieved relative to the surrounding housing by suitable selection of the arrangement of the supports. Thereby, the inlet opening in the exhaust pipe assumes a definite position with respect to the means which transfers exhaust gas from the cylinders of the internal combustion engine to the exhaust pipe.

In one embodiment, three suspension rods are distributed over the periphery of the exhaust pipe at the first station, and provide a secure support of the exhaust pipe in the axial direction. A stable arrangement of the suspension rods without play is provided in their supports by bracing in the axial direction.

In another embodiment, in which, instead of suspension supports over the cross section of the exhaust pipe, a support is provided at the first station, which does not permit longitudinal and transverse movement of the support point of the exhaust pipe relative to the housing. At the second station the suspension rods are arranged together with the braced support which make possible, a support apparatus with support reactions that are independent of the temperature load.

In one arrangement, the introduction of the external force is produced on a suspension rod by a spring acting on a bushing supporting the rod, the bushing being guided in a radially displaceable manner, the rod being inclined in the direction of the force to be introduced. It is thus appropriate, if the introduction of force is produced on a suspension rod arranged in the region of the second station and disposed in the plane defined by the vertical axis and the longitudinal axis of the exhaust pipe. The application of the external force can also be produced by means of a threaded bushing, which urges the suspension rod against the exhaust pipe. The elasticities of the structural parts serve as the elastic means.

The suspension rods of the supports are preferably formed as cylindrical rods with rounded ends to provide rackable pivotal movement in their supports on the exhaust pipe and the housing.

DETAILED DESCRIPTION OF PREFERRED EMBODIMENTS

Figure 1:
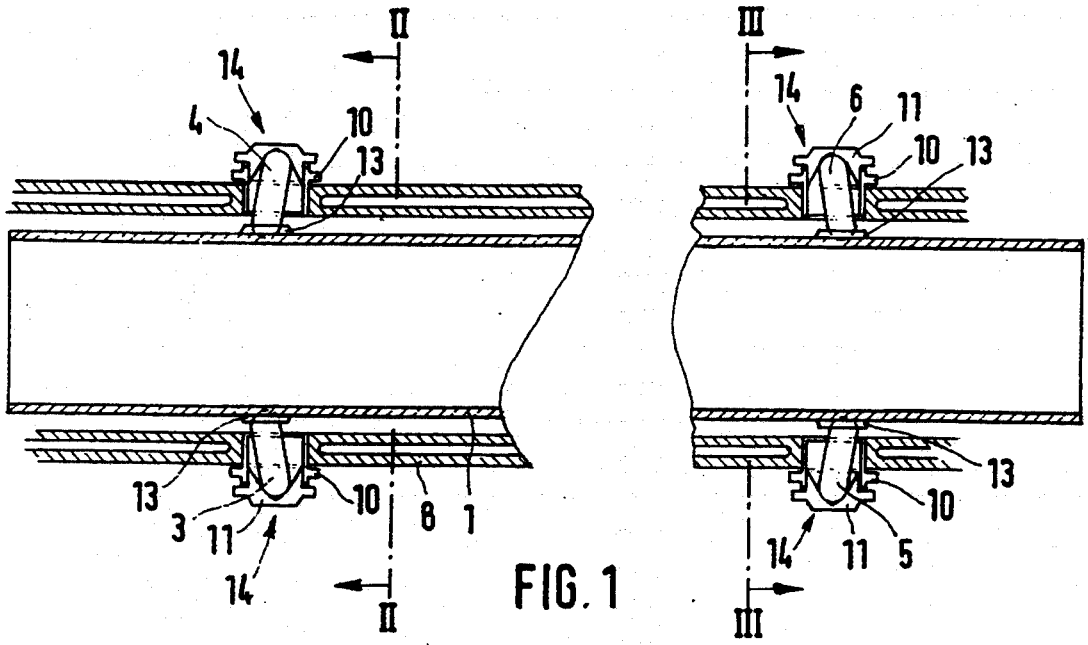
FIG. 1 is a longitudinal sectional view taken along line I—I in FIG. 2 of an exhaust pipe showing one embodiment of support apparatus therefor, the exhaust pipe being broken in length.
Figure 2:
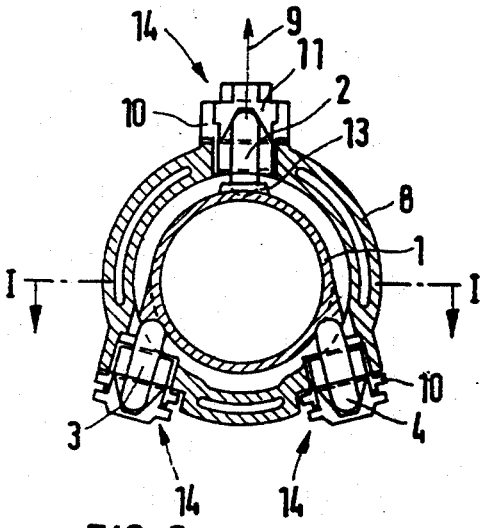
FIG. 2 is a sectional view taken along line II—II in FIG. 1.
Figure 3:
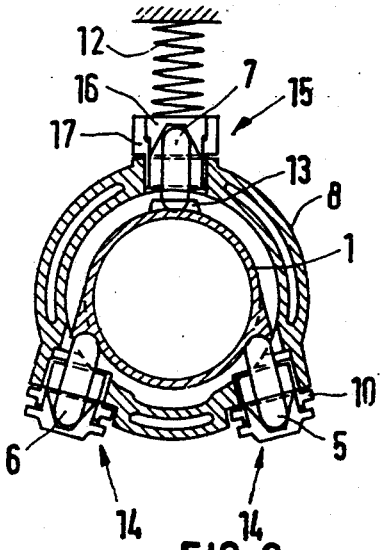
FIG. 3 is a sectional view taken along line III—III in FIG. 1

The exhaust pipe 1, in FIG. 1 is essentially formed as a straight piece of tubing with peripheral openings (not shown) for collecting exhaust gases from the combustion chambers of an internal combustion engine (not shown) by means of the exhaust manifolds (not shown). The exhaust manifolds are not physically connected to the exhaust pipe 1 and do not restrict the free expansion and contraction of the exhaust pipe 1. The exhaust pipe is supported at two axially spaced stations along the pipe from a housing 8 surrounding the pipe. The pipe 1 is supported on the housing 8 at the two stations by respective groups of three suspension rods 2, 3, 4 and 5, 6, 7. The suspension rods 2, 3, 4 at the first station, and the suspension rods 5, 6, 7 at the second station are respectively arranged at each station symmetrically with respect to the planes defined by the vertical axis 9 and a transverse axis. Bearings 13 on exhaust pipe 1 lie at the corners of an isosceles triangle symmetrical with respect to vertical axis 9. As can be seen from the figures of the drawing, suspension rods 2, 3, 4 and 5, 6, 7, are each arranged in the form of a tripod with short legs inclined relative to the longitudinal axis of exhaust pipe 1. The inclination of suspension rods 2, 3, 4 at the first station is opposite the inclination of suspension rods 5, 6, 7 at the second station. The suspension rods are each formed as cylindrical rods with rounded ends and each is engaged under pressure in a bearing 14 of housing 8 and in a bearing 13 on exhaust pipe 1. In the case of traction loads, more expensive spherical heads and corresponding bearings engaging the spherical heads would be necessary. Bearings 14 in housing 8 are formed by insert bushings 10, which are provided with covers 11 which can be screwed on the bushings. Covers 11, like bearings 13 are formed with internal hemispherical or other part-spherical bearing surfaces.

The suspension rod 7 at the second station is subjected to an external loading on bearing 15 by a prestressed radially arranged helical spring 12. In addition, cover 16 of the corresponding bearing 15 is guided in a radially displaceable manner in its bushing 17. The helical spring 12 develops an external force which is essentially constant and independent of the temperature of the pipe 1. The external force produces reaction forces of a predetermined magnitude in the suspension rods of the other supports. Instead of spring 12, a threaded bushing can also serve as a clamping device, by which bearing 14 of suspension rod 7 is braced against exhaust pipe 1 to apply external radial force to suspension rod 7. The elasticities of the structural parts operate in a way corresponding to helical spring 12.

A play-free engagement of all the suspension rods in their supports is obtained by the application of the external elastic force, independently of the expansion state of the exhaust pipe at all support points. Thus, by a suitable selection of the length of the suspension rods, their arrangement, or their oblique positioning, a specific displacement of the exhaust pipe can be obtained. In particular, it can also be accomplished that the perforations in the exhaust pipe for the introduction of the exhaust gases therein assume a defined position opposite the exhaust manifolds for a predetermined temperature load. In order to adjust the inclination of the suspension rods in their supports, for example, cover 11, in which suspension rod 2 is supported, is provided with a hexagonal adjusting nut. The oblique position of the suspension rods depends on the screw-in depth of cover 11. The application of external force or bracing of suspension rod 7, as mentioned, can be obtained by a threaded bushing, in which, bearing 15 for suspension rod 7 can be formed in the same way as bearing 14 for suspension rod 2.

Suspension rod 7 may also be omitted, and a stable support of the exhaust pipe will still be obtained, if the exhaust pipe is supported only by the suspension supports at the underside in the alignment according to the figures and is braced at the upper side against an elastic bearing so that a downwardly acting external force is applied to the exhaust pipe.

Figure 4:
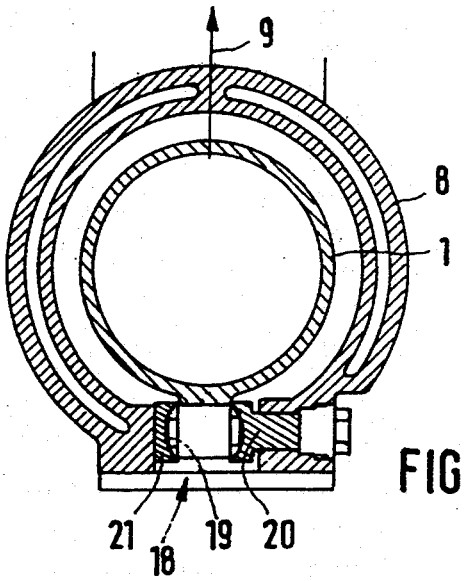
FIG. 4 is a sectional view similar to FIG. 2 showing a second embodiment of the support apparatus.

FIG. 4 shows a bearing 18 which can support the exhaust pipe instead of suspension rods 2, 3, 4. Free expansion of the exhaust pipe will not be hindered by bearing 18 as the bearing 18 provides a punctiform support about which the pipe 1 can undergo universal movement relative to the housing. Longitudinal and transverse movements of the support point relative to housing 8 are blocked. However, rotation of the exhaust pipe around axes parallel to the vertical, transverse, and longitudinal axes of the exhaust pipe are possible. For this purpose, the projecting end of a pin 19 formed with a spherical end surface is radially fixed to exhaust pipe 1, and the spherical surface is engaged in supports 20, 21 defining a corresponding spherical surface permitting universal rotational movements of the exhaust pipe around the center of the spherical surface. Thus an intentional force-free support with bearing reactions essentially independent of the temperature load is provided together with suspension rods 5, 6, 7 at the second station.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. Support apparatus for an exhaust pipe of an internal combustion engine comprising a support housing surrounding the exhaust pipe, first and second support means at two longitudinally spaced stations along said exhaust pipe, one of said support means including a plurality of support members inclined relative to a longitudinal axis of said exhaust pipe, said support members being supported by said housing and pivotably engaging the exhaust pipe to permit free longitudinal displacement of the exhaust pipe relative to the housing by pivotal movement of said support members, and means for elastically bracing the exhaust pipe relative to said housing by applying an external radial force against said exhaust pipe, the other of said support means supporting said exhaust pipe from said housing for displacement relative thereto, said inclined support members respectively comprising rods having ends respectively pivotably supported by said housing and by said exhaust pipe.

2. Support apparatus as claimed in claim 1, wherein said rods are inclined relative to said exhaust pipe at angles which are a function of the magnitude of said external force applied to the exhaust pipe.

3. Support apparatus as claimed in claim 2, wherein said other of said support means includes a further plurality of said inclined rods having respective ends pivotably supported by said housing and by said exhaust pipe, the rods of said one support means and the rods of said other support means being inclined in respective opposite directions.

4. Support apparatus as claimed in claim 3, wherein the means applying the external radial force acts at one of said inclined rods at said one station.

5. Support apparatus as claimed in claim 4, wherein said means applying the external radial force comprises a housing bearing, and a prestressed spring acting on said housing bearing, said housing bearing being supported for guided radial displacement in said housing to apply the force to the associated said one of said rods.

6. Support apparatus as claimed in claim 5, wherein said rods have rounded ends seated in rounded support surfaces associated with said exhaust pipe and said housing, said external applied force producing reaction forces in said rods which seat the rods in said support surfaces free of play.

7. Support apparatus as claimed in claim 3, wherein said other of said support means comprises a support between said exhaust pipe and said housing which provides universal movement of said exhaust pipe relative to said housing about a point radially displaced from said exhaust pipe.

8. Support apparatus as claimed in claim 7, wherein said support between the exhaust pipe and said housing comprises a pin extending radially outwards of said exhaust pipe, said pin having an external part-spherical surface, and a bearing secured to said housing having a corresponding part-spherical surface engaging the part-spherical surface of the pin to provide relative universal movement of the pin in the bearing about a center of the part-spherical surfaces as said point.

9. Support apparatus as claimed in claim 1, wherein said rods have rounded ends seated in rounded support surfaces provided respectively in said exhaust pipe and said housing to confer the pivotable support of said rods.

10. Support apparatus as claimed in claim 9, wherein said ends of the rods are universally rockable in their respective support surfaces.

* * * * *